US006405829B1

(12) United States Patent
Barnett

(10) Patent No.: US 6,405,829 B1
(45) Date of Patent: Jun. 18, 2002

(54) ANTI-SLIDE OUT DEVICES FOR STRAIGHT AND EXTENSION LADDERS

(75) Inventor: Ralph Lipsey Barnett, Wilmette, IL (US)

(73) Assignee: Triodyne Safety Systems, L.L.C., Niles, IL (US)

( * ) Notice: Subject to any disclaimer, the term of this patent is extended or adjusted under 35 U.S.C. 154(b) by 0 days.

(21) Appl. No.: 09/734,505

(22) Filed: Dec. 11, 2000

Related U.S. Application Data

(60) Provisional application No. 60/178,630, filed on Jan. 28, 2000.

(51) Int. Cl.[7] ..... E04G 5/02; E06C 7/06

(52) U.S. Cl. ..... 182/107; 182/214

(58) Field of Search ..... 182/214, 107, 182/106, 206; 248/210, 238

(56) References Cited

U.S. PATENT DOCUMENTS

| | | | | | |
|---|---|---|---|---|---|
| 530,374 | A | | 12/1894 | Wilkins | |
| 776,446 | A | | 11/1904 | Williamson | |
| 840,365 | A | | 1/1907 | Pease | |
| 1,017,599 | A | * | 2/1912 | Sharp | 182/214 |
| 1,294,345 | A | | 2/1919 | Maxwell | |
| 1,352,566 | A | | 9/1920 | Voll | |
| 1,710,026 | A | | 4/1929 | McCormick | |
| 2,176,551 | A | * | 10/1939 | Solem | 182/107 X |
| 2,256,452 | A | * | 9/1941 | Marshall | 182/214 |
| 2,272,642 | A | * | 2/1942 | Owen | 182/214 X |
| 2,597,902 | A | * | 5/1952 | Roketa | 182/214 |
| 2,788,930 | A | * | 4/1957 | Pals | 182/214 X |
| 2,803,388 | A | * | 8/1957 | Ross | 182/214 X |
| 2,868,427 | A | | 1/1959 | Hess | |
| 2,955,645 | A | * | 10/1960 | Cramer | 182/107 |
| 3,059,723 | A | | 10/1962 | Shore | |
| 3,118,234 | A | | 1/1964 | Wilson | |
| 3,396,815 | A | * | 8/1968 | Gleockler | 182/107 X |
| 3,773,143 | A | * | 11/1973 | Del Prete et al. | 182/214 |
| 4,130,181 | A | | 12/1978 | McCallum | |
| 4,143,743 | A | * | 3/1979 | Larson | 182/107 X |
| 4,311,207 | A | * | 1/1982 | Lurry | 182/214 X |
| 4,376,419 | A | * | 3/1983 | Heilskov | 182/197 X |
| 4,394,887 | A | * | 7/1983 | Spinks | 182/214 |
| 4,397,375 | A | * | 8/1983 | Hart | 182/214 X |
| 4,398,620 | A | * | 8/1983 | Townsend | 182/45 |
| 4,615,412 | A | * | 10/1986 | Clarke | 182/214 |
| 4,632,220 | A | | 12/1986 | Murrell | |
| 4,723,629 | A | | 2/1988 | Vanden Hoek et al. | |
| 4,869,345 | A | * | 9/1989 | Nilsen | 182/163 |

(List continued on next page.)

FOREIGN PATENT DOCUMENTS

| | | | | |
|---|---|---|---|---|
| GB | 2155528 | * | 9/1985 | 182/107 |

* cited by examiner

*Primary Examiner*—Daniel P. Stodola
*Assistant Examiner*—Hugh B. Thompson
(74) *Attorney, Agent, or Firm*—Pauley Petersen Kinne & Erickson

(57) ABSTRACT

A non-self-supporting ladder having an anti-slide-out device which enables a user to set up the ladder at the specified minimum ladder set-up angle θ or greater angles for precluding the base of the ladder from sliding away from a structure against which the ladder is leaning upon application of a weight on the ladder, but prevents the ladder to be set up at angles smaller than θ. The device includes an inboard roller assembly having a bracket connected to each side rail of the ladder and a roller connected to each bracket oriented and disposed so as to impose a specified ladder inclination angle θ, when the lower end of the ladder and the rollers simultaneously rest on a substantially flat horizontal surface. At set-up angles smaller than the specified minimum angle θ, only the rollers rest on the horizontal surface, preventing the ladder from being set up.

13 Claims, 19 Drawing Sheets

U.S. PATENT DOCUMENTS 4,938,312 A * 7/1990 Trail ..... 182/214 X
5,123,503 A * 6/1992 Clarke ..... 182/107
5,341,899 A 8/1994 Casamento
5,373,913 A 12/1994 Santos
5,740,881 A 4/1998 Lensak
5,918,698 A 7/1999 Lunn
6,250,424 B1 * 6/2001 Laug ..... 182/107
6,276,490 B1 * 8/2001 Swanick, Jr. ..... 182/107

ANTI-SLIDE OUT DEVICES FOR STRAIGHT AND EXTENSION LADDERS

CROSS REFERENCE TO RELATED APPLICATION

This application claims the priority benefit of Provisional U.S. patent application Ser. No. 60/178,630 filed Jan. 28, 2000.

BACKGROUND OF THE INVENTION

1. Field of the Invention

This invention relates to a straight or extension ladder comprising anti-slide-out means for determining the minimum ladder set-up angle whereby the base of the ladder is precluded from sliding away from the wall or other structure against which the ladder is leaning upon application of a weight on the ladder.

2. Description of Prior Art

A straight or extension ladder maintains its equilibrium when placed against a wall or other structure by the friction resistance against sliding that is created between the side rail feet and the ground surface. When this friction force is not sufficient, the base of the ladder slides away from the wall dropping its climber. Over one-third of all ladder accidents are caused by ladder slide-out.

The equations of equilibrium for straight or extension ladders indicate that the resistance against slide-out increases with the steepness of the ladder. The steepness of the ladder is normally characterized by the acute angle formed between the ground surface and the center line of the ladder. In the United States, ladders are designed and tested using an angle of 75.52°, which is also used as the limiting ladder set-up angle to avoid slide-out. The safety factor against ladder slide-out falls off very quickly as the ladder angle becomes shallower.

There are a number of popular techniques for establishing the 75.52° ladder angle. The first of these is the one-in-four method by which the angle is set by arranging the geometry such that the base-to-wall distance is one-forth of the active ladder length.

Another method involves the mounting of an "L" on the side rail of the ladder in a special orientation. When the ladder is correctly set up, the L achieves a natural orientation with its legs in a vertical and horizontal direction.

Yet a third method involves anthropometric set-up in which four instructional steps are placed on ladder labels to achieve a ladder angle of approximately 75°. These instructional steps are—1) place toes against bottom of ladder side rails; 2) stand erect; 3) extend arms straight out; and 4) palms of hands should touch top of rung at shoulder level.

A further means for achieving proper set-up of a ladder is taught by U. S. Pat. No. 2,845,719 wherein a bubble level is attached to the outside of the ladder side rail at eye level to disclose any chosen set-up angle. U.S. Pat. No. 3,118,234 teaches a pendulum device attached to the outside of the ladder side rail whereby, when the ladder is set up at a ladder angle of 75°, a mark on the pendulum housing lines up with the pendulum. If the ladder base is too far in or out, the pendulum housing is marked appropriately "move, in" or "move out" so that the user will move the ladder base in the correct direction.

U.S. Pat. No. 5,740,881 teaches yet another approach in which an electronic circuit alarm are attached to a ladder with two sensors. One of the sensors determines the side-to-side orientation of the ladder while the other determines the ladder inclination angle. When incorrectly set up, the alarm sounds and the actual angles are displayed.

Yet another device for determining proper inclination of a ladder is a "monster eye", named after a toy, which is mounted under the sixth base section rung at eye level. The monster eye consists of two concentric spheres, the inner sphere of which is opaque and weighted on one side and the outer sphere of which is transparent. Between the spheres, the space is filled with liquid that allows the inner sphere to rotate freely so that its weighted side can remain in a downward-facing orientation. When en equator line on the inner sphere falls between two closely spaced parallel lines painted around the equator of the outer sphere, the ladder has achieved an inclination angle of 75.5°.

One problem associated with each of the above described methods and devices is that the set-up protocol may be completely ignored by the users, who may adopt any arbitrary inclination angle that suits their immediate fancy, risking thereby a non-safe ladder set-up.

It will also be appreciated that there are numerous devices known in the art for stabilizing a ladder. U.S. Pat. 5,341,899 teaches an anti-skid hand leveling device for ladders which includes a pair of devices consisting of a guide rail along which an upper carriage and a lower carriage slide independently. The upper carriage provides a mounting platform onto which a brace is rotatably mounted. The lower carriage provides a mounting platform onto which an outrigger-type foot is mounted. When pivoted to a specified angle and lowered so as to contact the ground, the brace prevents the ladder from skidding in a direction away from the object against which the ladder is resting. Similar devices are taught by U.S. Pat. No. 4,723,629 and U.S. Pat. No. 4,130,181. See also U.S. Pat. No. 5,918,698; U.S. Pat. No. 4,632,220; U.S. Pat. No. 3,059,723; U.S. Pat. No. 2,868,427; U.S. Pat. No. 1,710,026; U.S. Pat. No. 1,352,566; U.S. Pat. No. 840,365; U.S. Pat. No. 776,446; and U.S. Pat. No. 530,374. Although providing stabilization for straight and extension ladders, none of these prior art references provides any means for ensuring proper set-up of the ladder so as to preclude ladder inclination angles below a specified limiting ladder set-up angle.

SUMMARY OF THE INVENTION

Accordingly, it is one object of this invention to provide an apparatus for ensuring proper ladder inclination angles which preclude slide-out of the base of the ladders upon application of a weight to the ladder.

It is another object of this invention to provide a method and apparatus for proper ladder set-up which passively rejects any ladder inclination angle below a specified limiting ladder set-up angle θ, for example 75.5°.

These and other objects of this invention are addressed by a non-self-supporting ladder comprising two substantially parallel, elongated, spaced apart side rails having an upper and a lower end and a plurality of substantially parallel, spaced apart rung elements joining the spaced apart side rails. An inboard roller assembly comprising a bracket and a roller rotatable over its central axis is connected to each of the spaced apart side rails, whereby the central axes of the rollers are oriented so as to be essentially parallel to the spaced apart rung elements joining the spaced apart side rails. The inboard roller assemblies are disposed so as to impose a specified ladder inclination angle θ when the lower end of the spaced apart side rails and the rollers rest on a substantially flat horizontal surface.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
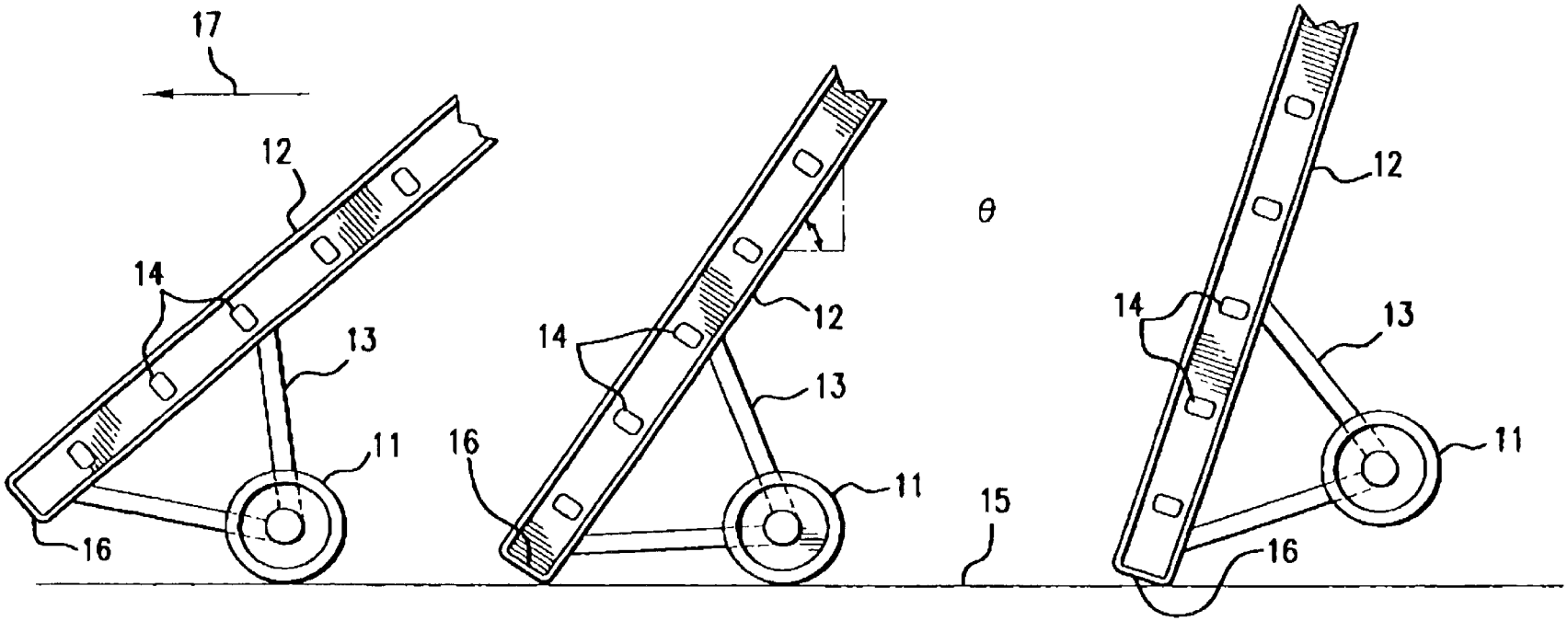
FIG. 1 is a side view of the lower portion of a rigid ladder system at different inclination angles having an anti-slide-out device in accordance with one embodiment of this invention.

If frictionless wheels are fixed to the base of a ladder to act as its feet, the ladder cannot support either itself or a live load. For any angle of inclination, the ladder will slide out away from the vertical wall or structure against which it is leaning. FIG. 1 shows the bottom portion of a ladder comprising side rail 12 and rungs 14 and a device for determining the proper set-up inclination angle for the ladder in accordance with one embodiment of this invention comprising outrigger or bracket 13 attached to the base of the ladder, which bracket 13 supports roller 11. Roller 11 in accordance with one embodiment of this invention is a pneumatic tire wheel. One such device is attached to each side rail 12. Three dispositions of the ladder are shown in FIG. 1. As illustrated in the center disposition, rollers 11 are located so that the ladder base 16 and rollers 11 simultaneously touch horizontal surface or ground 15 when the ladder inclination angle achieves the desired set-up angle, θ. At angles steeper than θ, as shown in the right-most disposition, rollers 11 are lifted above surface 15 leaving the ladder base 16 in contact with the support surface 15. It should be noted that steeper set-up angles, such as that shown in the right-most disposition, are more difficult from which to slide out. By contrast, the left-most disposition of the ladder shown in FIG. 1 depicts a ladder inclination that is shallower than the desired set-up angle θ. In this case, ladder base 16 is above the surface 15 and the ladder is supported only by rollers 11. Consequently, the ladder will start falling because the ladder base will propel itself in the direction away from the support wall or structure. If the user does not oppose this motion, the ladder will fall against the ground.

An examination of the "too shallow" case shown in FIG. 1 reveals three feed-back mechanisms that indicate to the user an improper inclination angle. First, ladder base 16 can be seen not touching the ground 15. Second, the ladder will push against a user standing in front of the ladder or it will accelerate in the direction indicated by arrow 17. Finally, if the ladder is not too heavy, attempts to mount the lowest of the rungs 14 will lift the top of the ladder up off the support structure. There is a seesaw action that gives rise to a fulcrum rotation about the axles of rollers 11. The seesaw action is associated with rollers 11 positioned inboard of the bottom rung as illustrated in FIG. 1.

In a rigid world, a climber would adjust the ladder to achieve simultaneous contact of the ladder base 16 and rollers 11. Then, a slight additional rearward movement would permanently elevate the rollers 11 and allow climbing to proceed. In the real world of flexibility, the ladder will sag when supporting a climber. Unfortunately, this sag will always rotate the ladder base 16 in a direction which moves rollers 11 downward. It is possible for this downward movement to jack up the ladder base 16 causing the ladder base 16 to leave the ground 15 and remove all resistance to slide-out. The climber and the ladder collapse together as rollers 11 run away from the supporting wall or structure. This fail-to-danger scenario may be actively averted by instructing the user to leave a specified ground clearance beneath the rollers during set-up. On the other hand, a passive system may be used to preclude the roll out phenomenon entirely.

Figure 2:
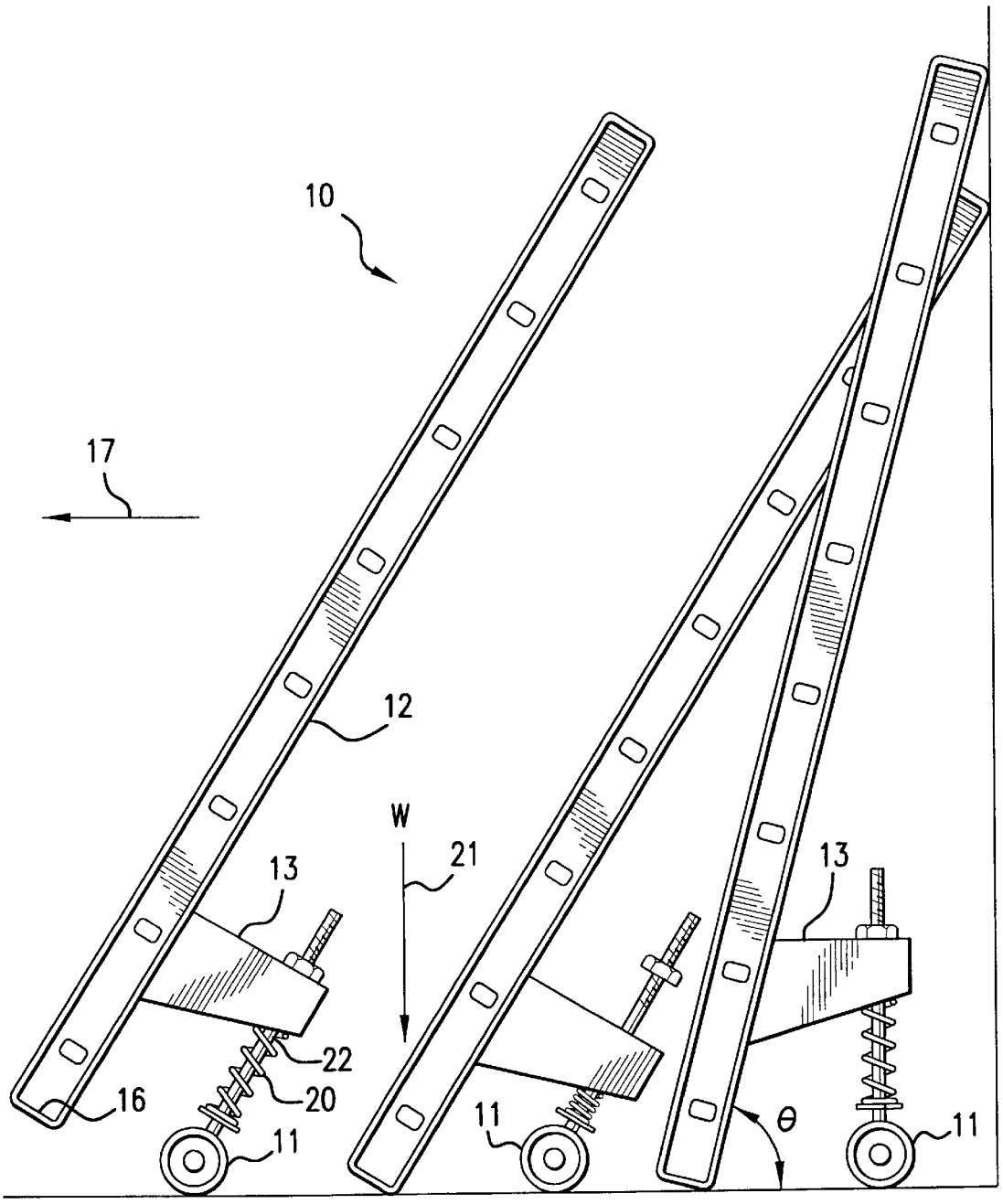
FIG. 2 is a side view of a ladder having an anti-slide-out device in accordance with one embodiment of this invention showing equilibrium and non-equilibrium states for the ladder.

Such a system is shown, for example, in FIG. 2 in which rollers 11 are spring loaded. At shallow angles less than the desired set-up angle θ, the left-most illustration of FIG. 2, spring 20 carries the weight of ladder 10 and any extension sections thereof with a safety factor, for example 1.5 times the ladder weight. In this state, the ladder base 16 is elevated from the ground surface and the ladder 10 will accelerate away from the support wall or structure in the direction of arrow 17. This state provides both visual and tactile feed-back relative to the improper set-up angle. At any shallow angle less than θ, the user may stabilize the ladder with his hands while he mounts a rung. This live load, indicated by arrow 21, on ladder 10 will overcome the pre-load in spring 20 and allow ladder base 16 to push against the ground with sufficient force to develop almost the full frictional resistance to slide-out associated with the specific ladder inclination. This situation is shown in the center illustration of FIG. 2 using conventional spring loaded rollers often found in self-supported ladder stands. The set-up shown in the right-most illustration of FIG. 2 shows a ladder at the exact inclination angle θ desired or specified by standards or codes. Currently, this angle is 75.52°. Theoretically, an infinitesimally larger angle than θ will completely lift rollers 11 from the ground surface allowing side rails 12 to develop their fall resistance to slide-out. If ladder sag under live load should force rollers 11 into the ground, they cannot cause the side rails to lift because their lifting or jacking capability is limited to the spring force. The spring force is always small; it is somewhat larger than the self weight of the ladder. The anti-slide-out device in accordance with the embodiment shown in FIG. 2 comprises a passive spring system. Bracket 13 is connected to side rail 12 of ladder 10 and roller 11 is attached to rod 22 which is slidably connected to bracket 13. That portion of rod 22 between roller 11 and bracket 13 is surrounded by preloaded spring 20. This passive spring system adds robustness to the anti-slide-out safety system of this invention. It should be noted that rollers 11 enable ladder 10 to be moved in the same manner as a wheelbarrow.

In accordance with other embodiments of this invention, spring loaded rollers such as those shown in FIG. 2 are automatically removable from active participation once a live load is imposed on the ladder. Some embodiments of this property are shown in FIGS. 3, 4, 5*a*–5*e*, 6*a*–6*e* and 7.

Figure 3:
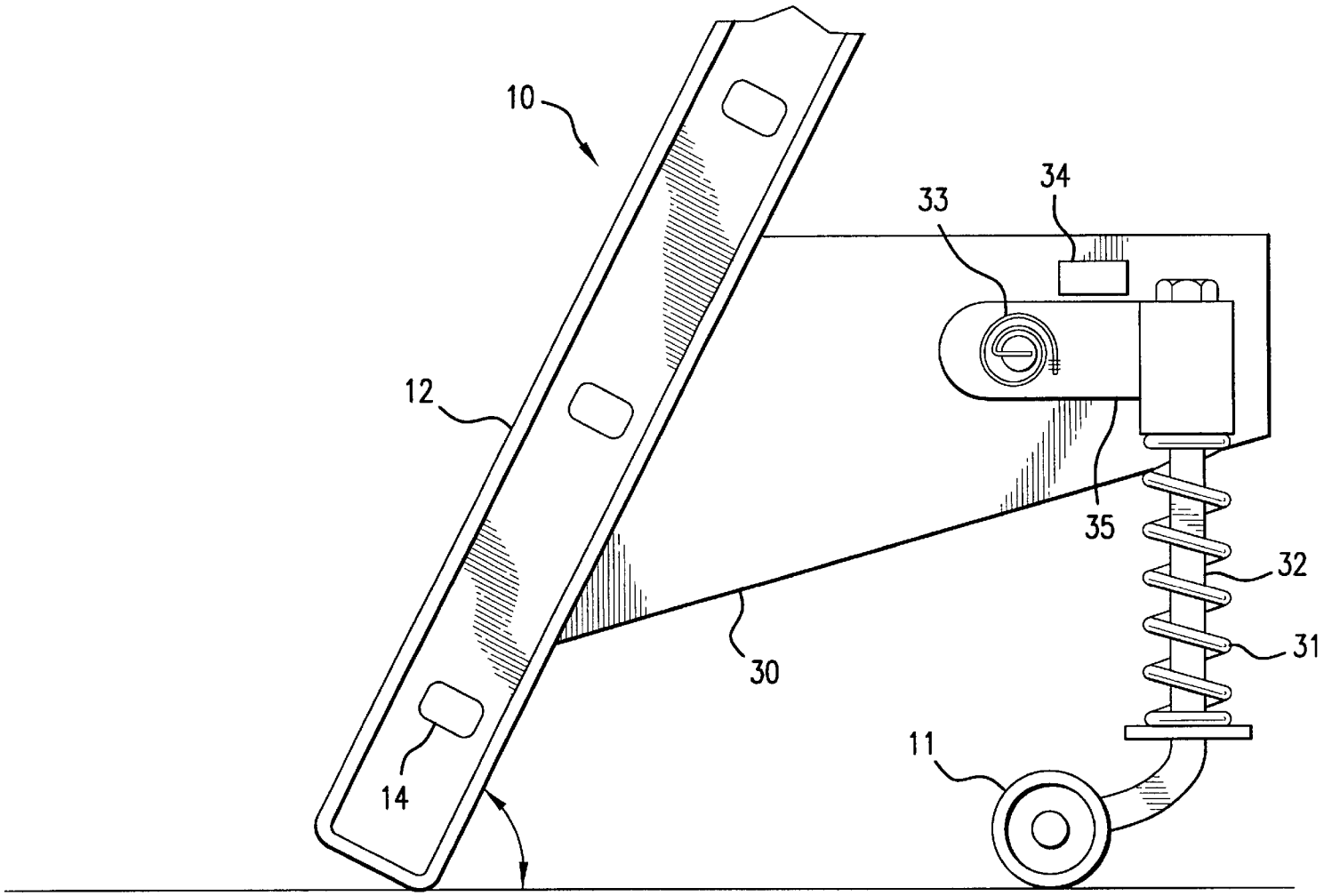
FIG. 3 is a side view of an anti-slide-out device for a ladder employing an eccentric mechanism in accordance with one embodiment of this invention.

FIG. 3 shows one embodiment of the anti-slide-out device of this invention oriented so as to provide the desired angle of inclination θ. The device comprises fixed bracket 30 attached to side rail 12 of ladder 10. Roller 11 is disposed at one end of square rod 32 around which is disposed compression spring 31. The opposite end of square rod 32 is connected to hinged fitting 35, which, in turn, is hingedly connected to fixed bracket 30. Hinged fitting 35 comprises torsion spring 33 which tends to rotate hinged fitting 35 against stop 34. Any loads transferred to roller 11 in an upward direction will also hold hinged fitting 35 against stop 34. The eccentricity of roller 1I relative to hinged fitting 35, together with the spring constant of torsion spring 33 and compression spring 31 may be combined with the preloading of the two springs to maintain contact of hinged fitting 35 with stop 34 under the self weight of ladder 10. On the other hand, if the inclination of ladder 10 is shallow, and if a live load is placed on ladder 10, the mechanism assumes the geometry shown in FIG. 4. In this configuration, almost no upward force is exerted on ladder 10 by the roller mechanism. Even when the live load is removed, a ladder 10 will not be lifted by the mechanism and the original configuration shown in FIG. 3 will not be recovered. To restore the original/initial geometry of FIG. 3, the user must lift the ladder and allow torsion spring 33 to recock the system.

Figure 4:
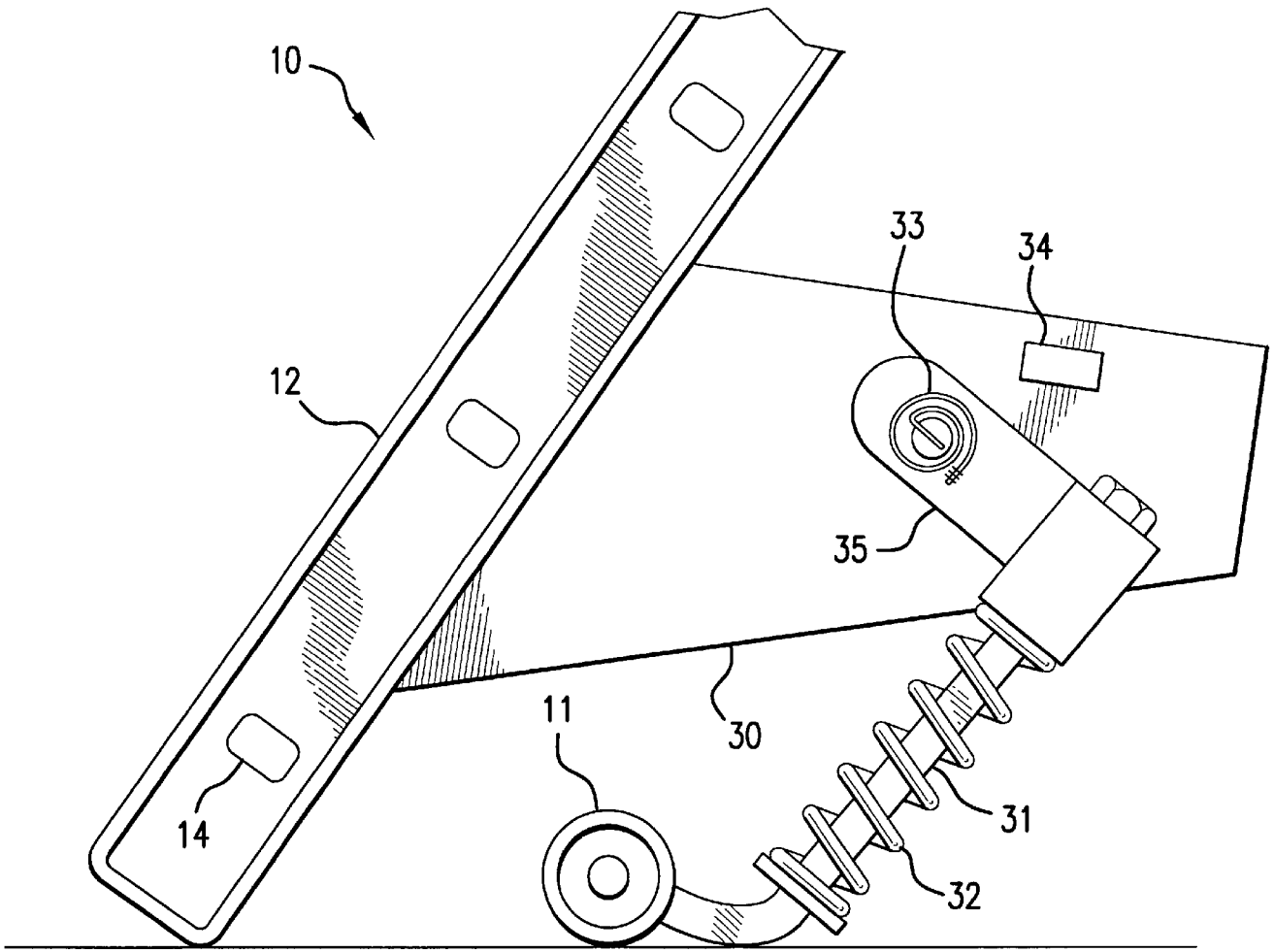
FIG. 4 is a side view of the anti-slide-out device shown in FIG. 3 with the eccentric mechanism at a shallow inclination angle after loading.

It can, thus, be seen that the eccentric mechanism of FIGS. 3 and 4 provides two additional safety features. First, when the ladder is misused, that is set up at shallow angles:, the spring system will not reduce the force on the side rail feet which might compromise the frictional resistance to slide-out. Second, when the user dismounts a ladder set up at a shallow angle, compared to the desired angle of inclination, the ladder will remain in equilibrium and not push back from the vertical support structure.

In accordance with the embodiment of FIGS. 3 and 4, the roller suspension system is unloaded when the selfweight and live load on the ladder exceed a preset limit. The user can reset or reactivate the suspension system merely by lifting the ladder of the ground surface.

Figure 5A:
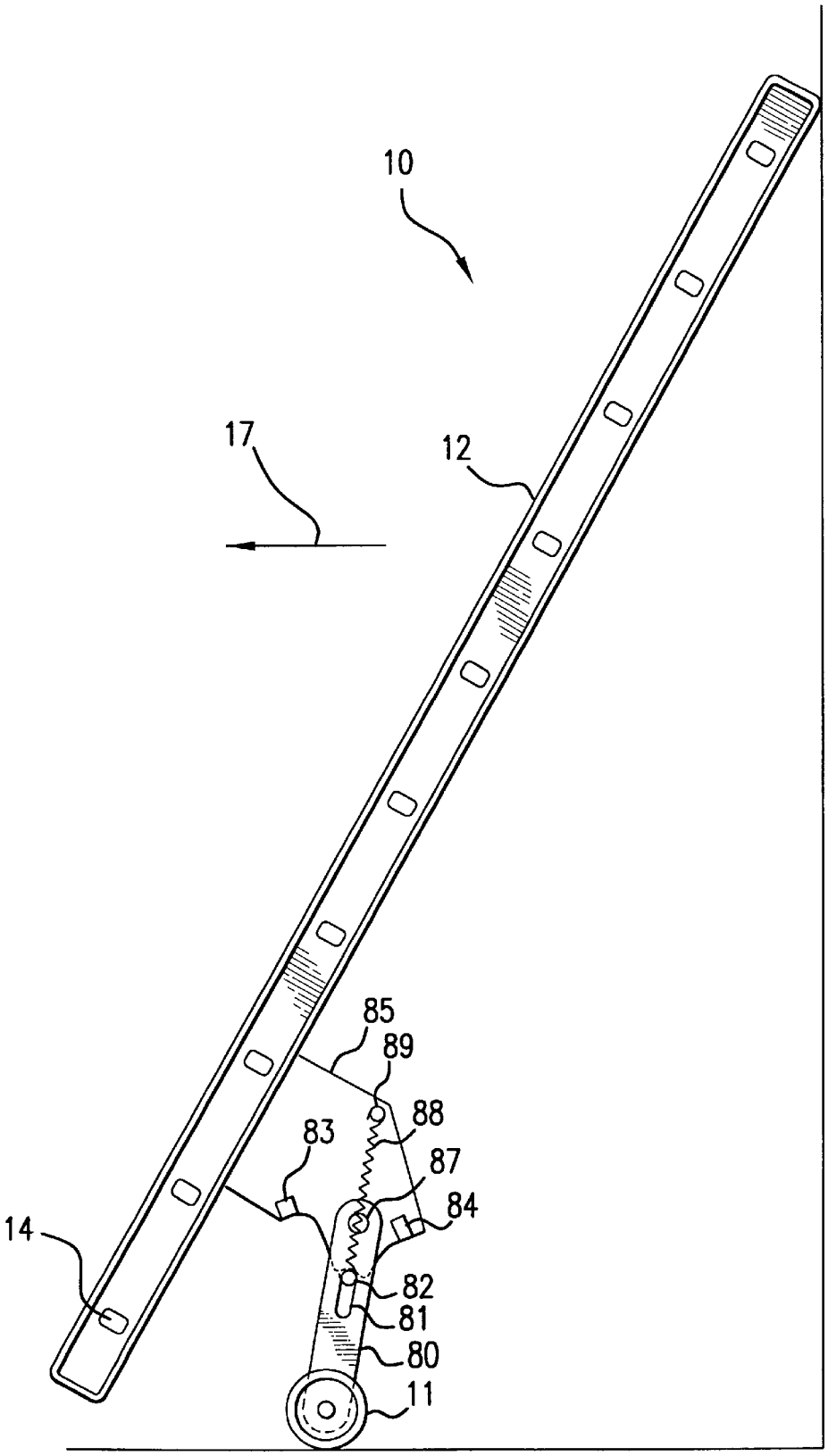
FIGS. 5*a*–5*e* are side views of an anti-slide-out device at various load conditions and inclination angles in accordance with one embodiment of this invention.
Figure 5B:
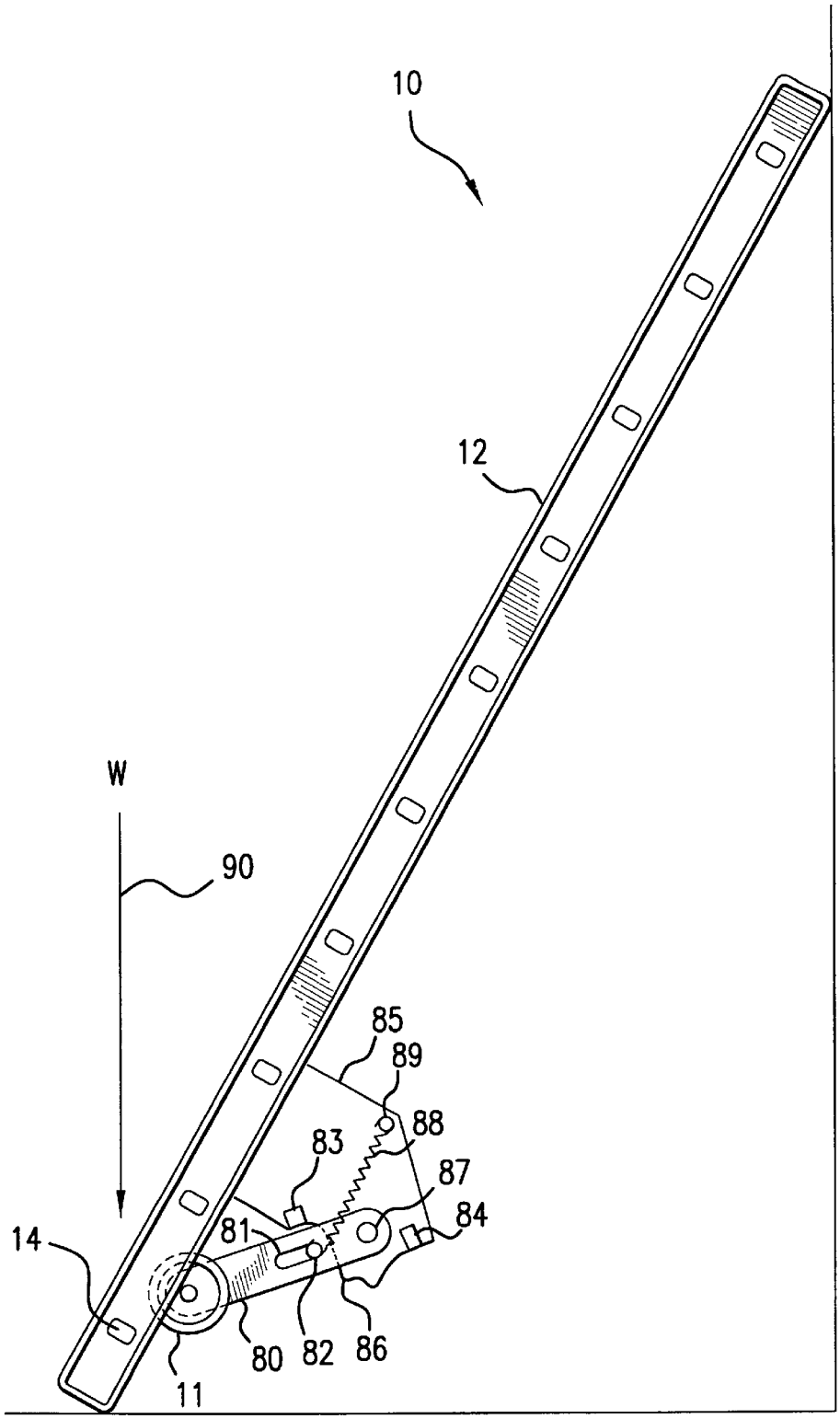

Another embodiment of the anti-slide-out device of this invention is shown in FIGS. 5*a*–5*e*. The device, detailed in FIG. 5*e* comprises roller mechanism support bracket 85 which is fixedly connected to the ladder 10. Roller 11 is disposed at one end of roller arm 80, the opposite end of which is pivotably connected by means of pivot shaft 87 to roller mechanism support bracket 85. Roller arm 80 forms a longitudinally oriented detent slot 81 in which is disposed a detent pin 82. One end of over-the-center pretensioned detent spring 88 is connected to detent pin 82 and the other end of over-the-center pretensioned detent spring 88 is connected to spring supporting 89 extending outwardly from roller mechanism support bracket 85. Roller mechanism support bracket 85 farther comprises roller arm stops 83, 84 disposed on either side of roller arm 80. An edge portion of roller mechanism support bracket 85 disposed between roller arm stop 83 and roller arm stop 84 forms a detent cam 86. In operation, detent pin 82 is held against the cam profile 86 by means of over-the-center pretension spring 88, which is designed to carry the weight of the ladder, and any extension sections, with a small safety factor, in a manner similar to that of FIG. 2 previously described. At shallow angles less than the desired angle of inclination θ, as shown in FIG. 5*a*, the anti-slide-out device in accordance with this embodiment carries the weight of the ladder but the side rail feet are elevated from the ground surface resulting in acceleration of the ladder away from the support wall or structure. This state provides both visual and tactile feedback relative to the improper set-up angle. At any shallow angle less than θ, the user may stabilize the ladder with his hands while mounting a rung 14. This live load on the ladder acts through roller 11 on roller arm 80, pushing detent pin 82 over the cam hump of detent cam 86. The action by the over center pretensioned detent spring 88 moves roller 11 together with roller arm 80 out of the way toward the ladder as shown in FIG. 5*b*. This roller state provides the user with an immediate visual feedback that the set-up angle was improper. However, the feet of side rails 12 will now be in contact with the ground, pushing against it with sufficient force to develop the full frictional resistance to slideout associated with the specific ladder inclination.

Figure 5C:
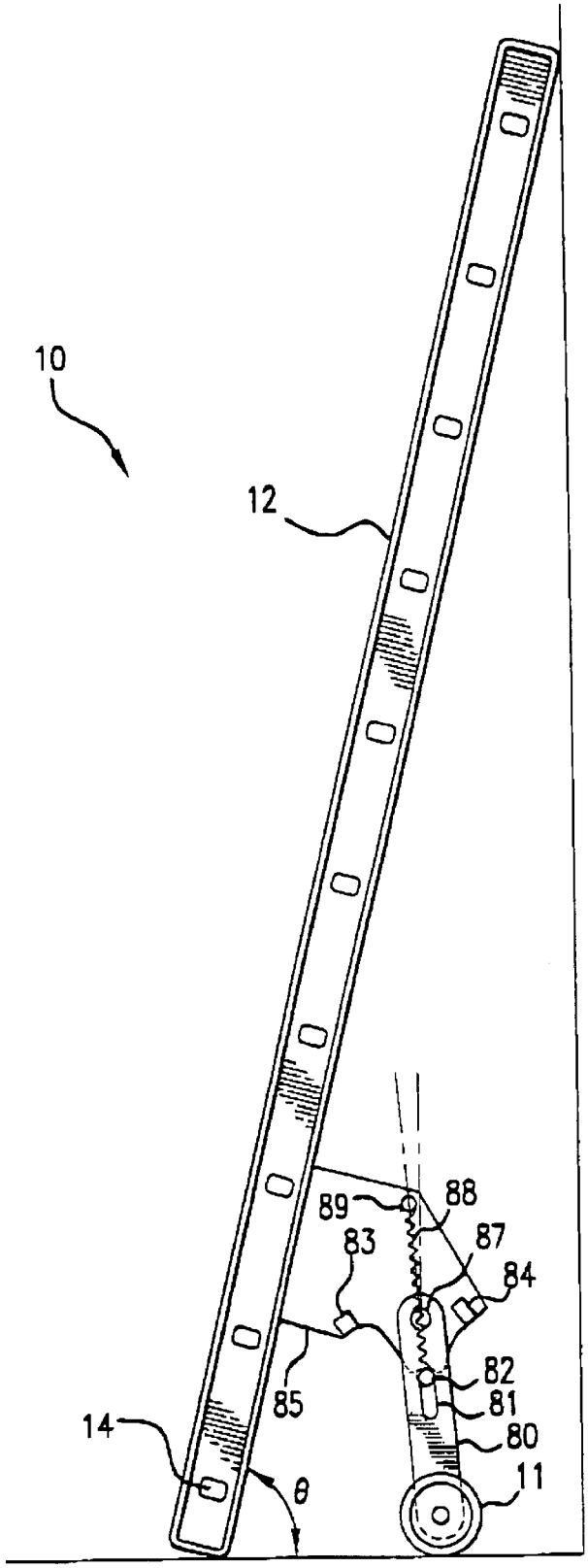
Figure 5D:
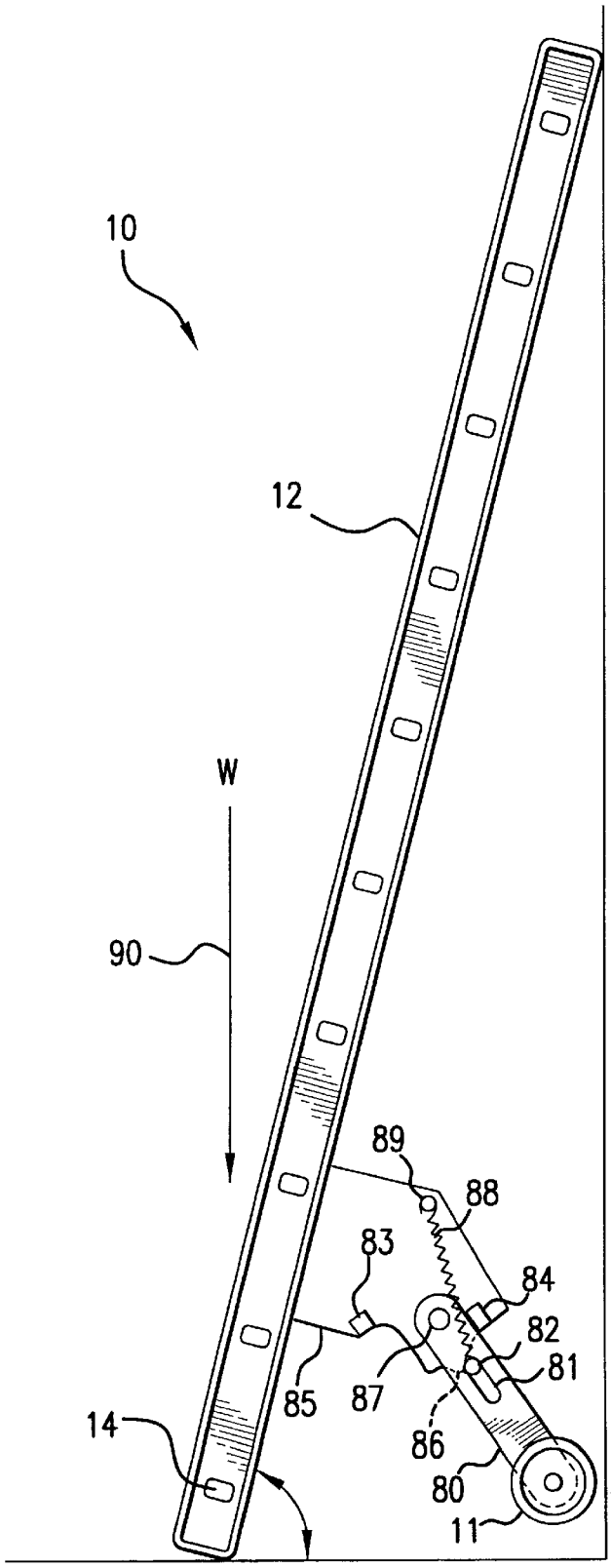
Figure 5E:
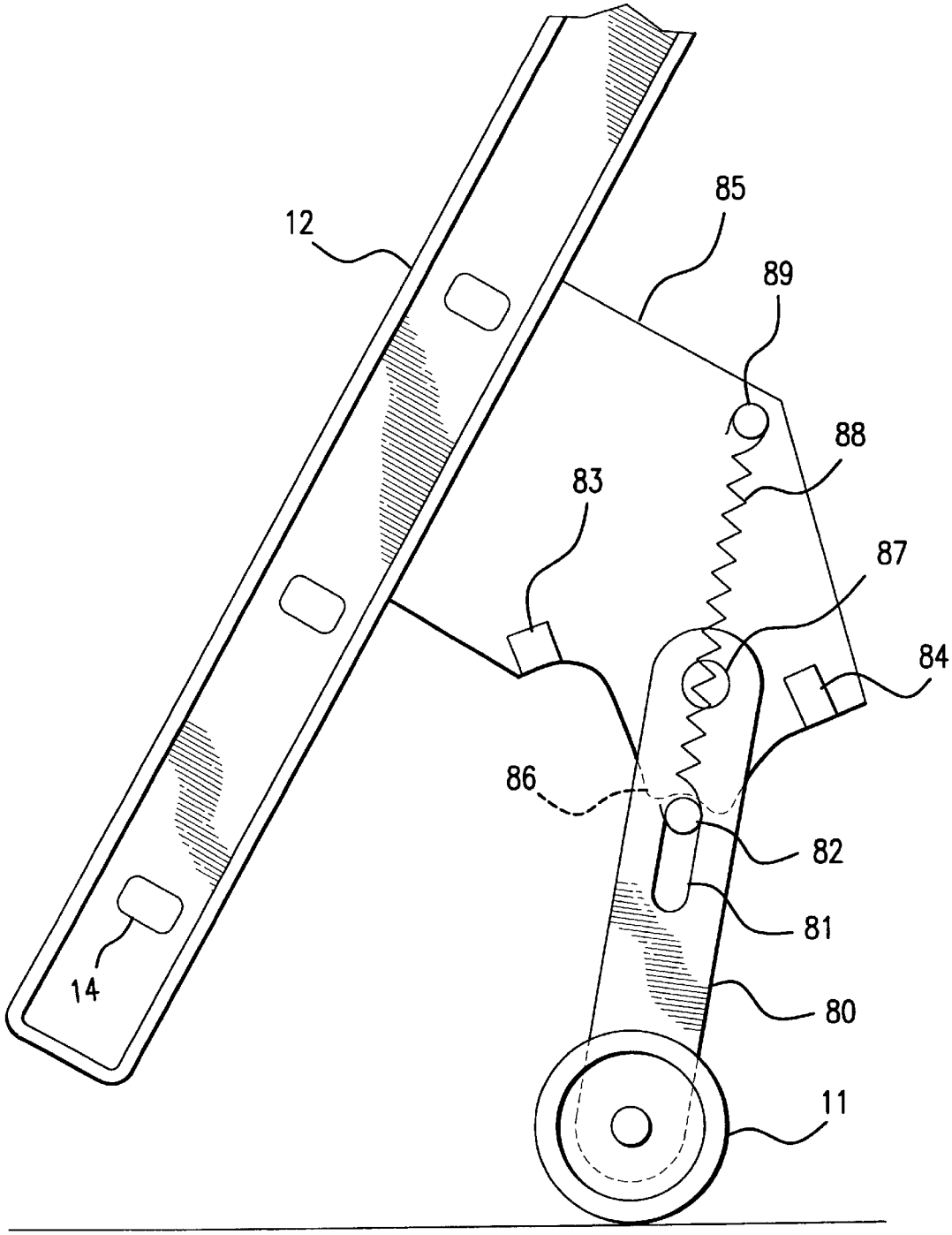

FIG. 5*c* shows ladder 10 employing the anti-slide-out cam and detent mechanism of FIG. 5*e* at the exact inclination angle θ desired or specified by standards or codes. A larger angle than θ will lift the rollers 11 from the ground surface allowing the side rails 12 to develop their fall resistance to slide-out. If ladder sag under live loads should happen to push rollers 11 against the ground, rollers 11 will not cause side rails 12 to lift. Instead, as shown in FIG. 5*d*, the sag will act through roller 11 on roller arm 80, pushing detent pin 82 over the cam hump of detent cam 86 resulting in action by the over center pretensioned detent spring 88 moving roller 11 with roller arm 80 out of the way, in a direction away from ladder 10 leaving only the feet of side rails 12 to contact the ground and to develop their full resistance to slideout. This roller state provides the user with an immediate visual feedback that the setup angle was proper in contrast to that of FIG. 5*b*. After using the ladder, the user can restore roller 11 to its neutral position by hand by moving roller arm 80 to the position shown in FIG. 5*e*, or for storing purposes by moving roller arm 80 to the position shown in FIG. 5*b*.

Figure 6A:
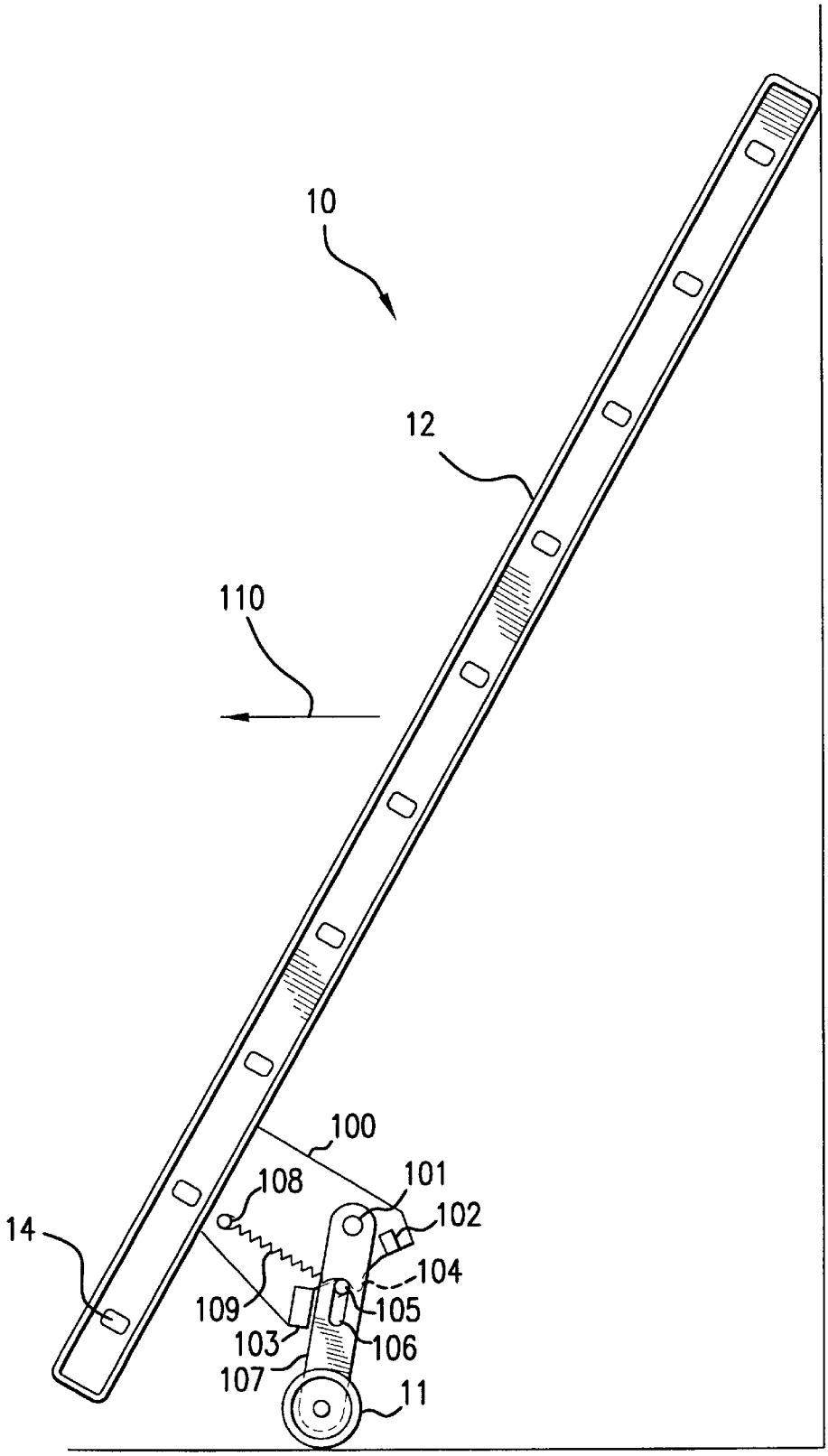
FIGS. 6*a*–6*e* show side views of an anti-slide-out device for a straight or extension ladder in accordance with one embodiment of this invention.
Figure 6B:
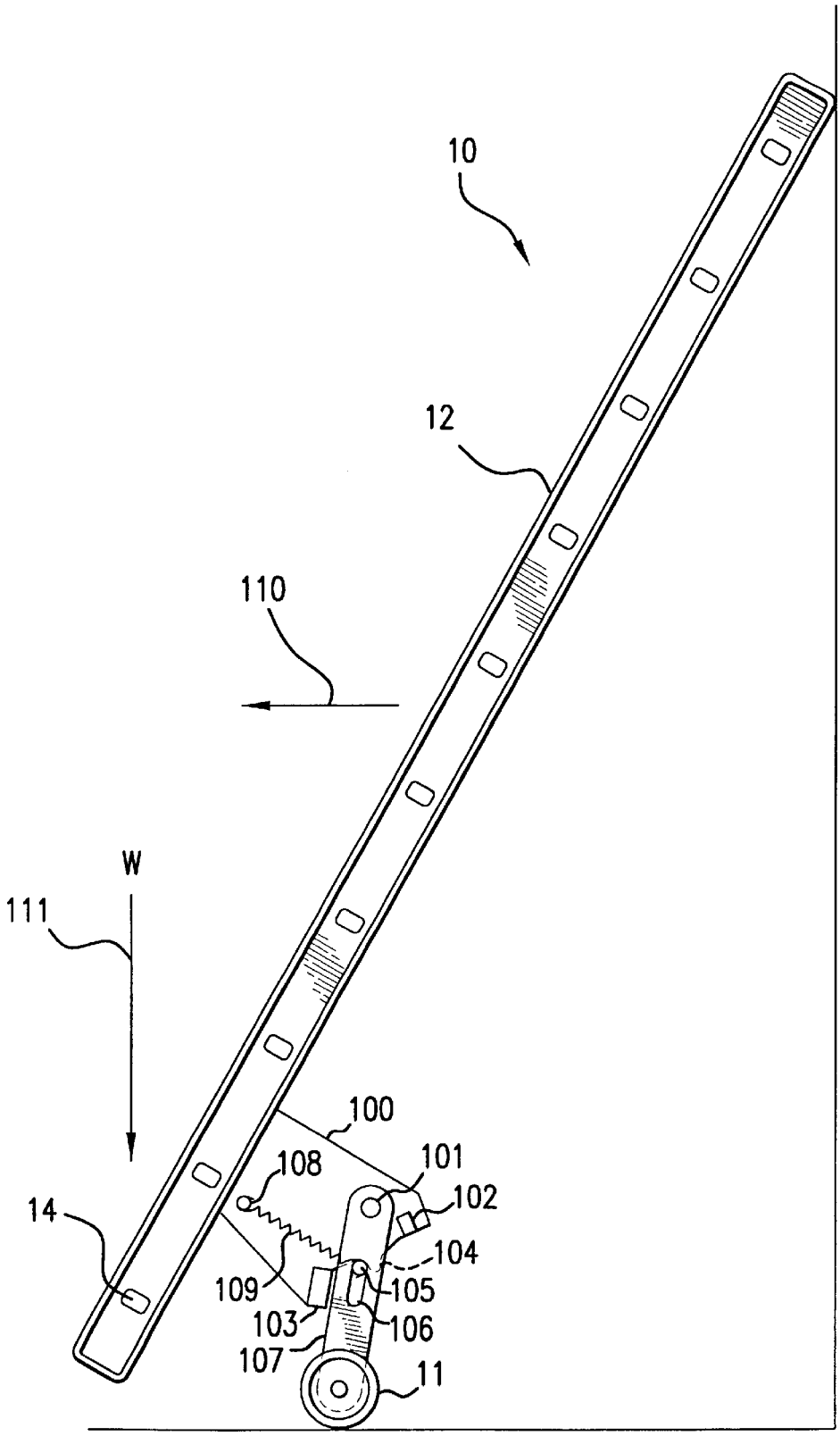
Figure 6C:
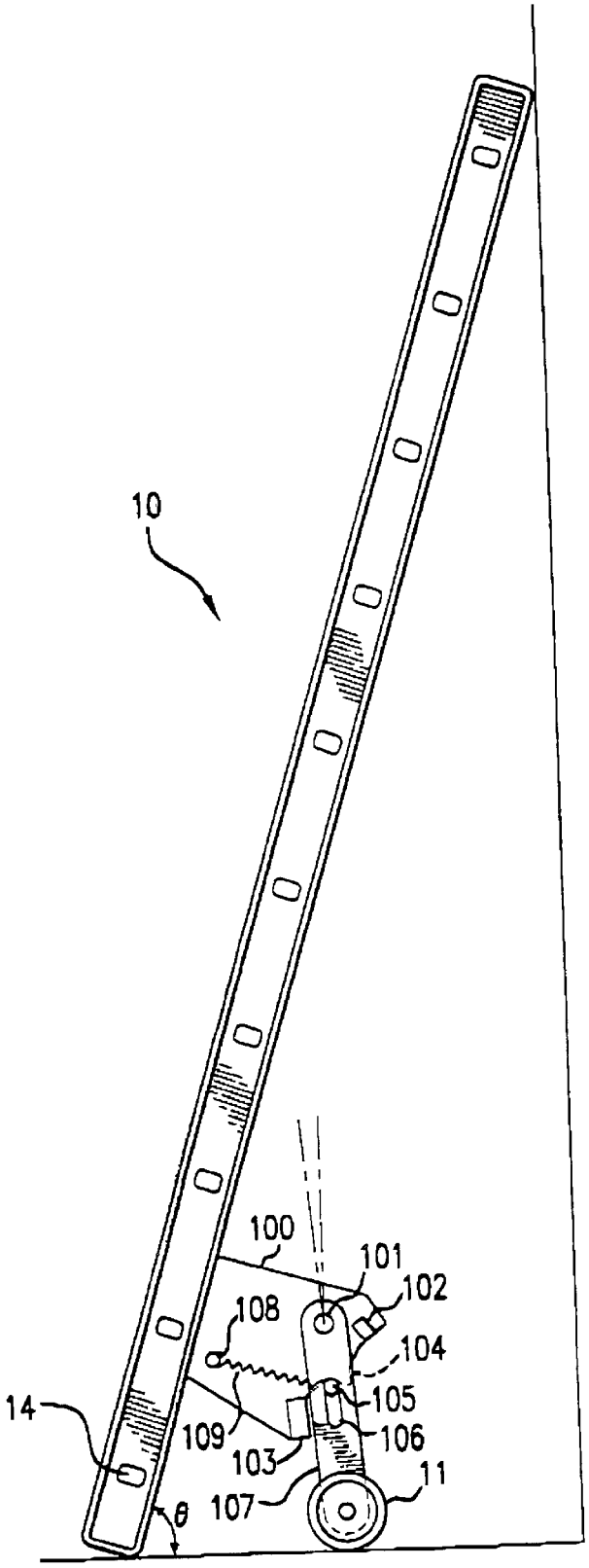
Figure 6D:
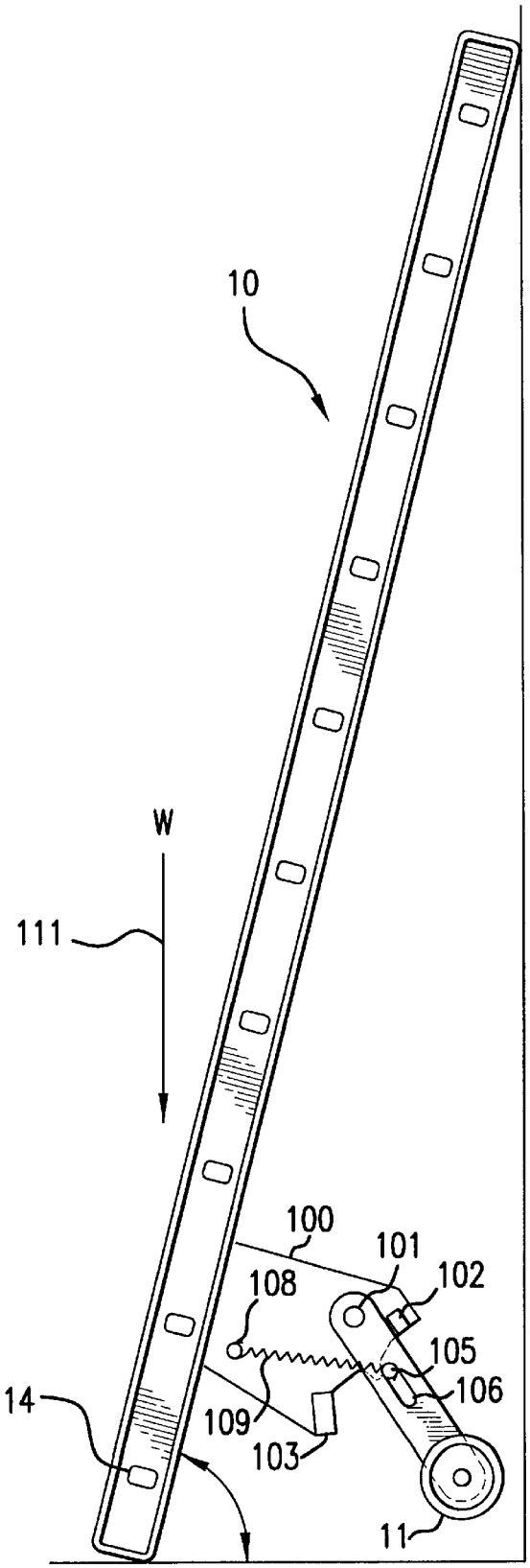
Figure 6E:
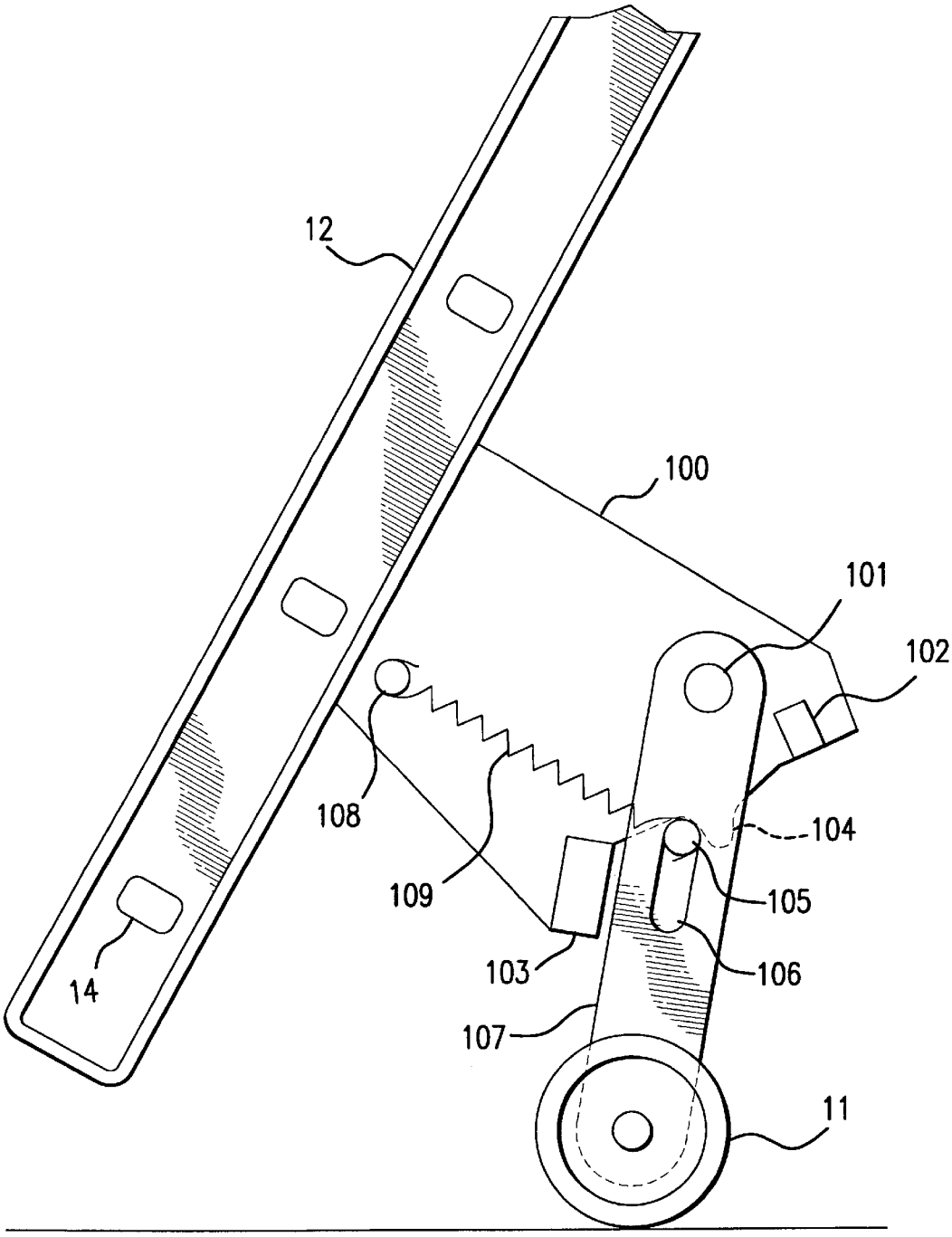

A further embodiment of the anti-slide-out device of this invention is shown in FIGS. 6*a*–6*e*, which embodiment employs the roller support device detailed in FIG. 6*e*. The device comprises roller mechanism support bracket 100 attached to ladder 10 and roller arm 107 having one end pivotally connected by means of roller arm pivot shaft 101 to roller mechanism support bracket 100 and having an opposite end connected to roller 11. Roller arm 107 forms detent slot 106 in which is disposed a detent pin 105. The device further comprises pretensioned spring 109 having one end connected to detent pin 105 and having an opposite end connected to spring support pin 108 connected to and extending from one face of roller mechanism support bracket 100. Roller mechanism support bracket 100 further comprises roller arm stops 102 and 103 disposed on either side of roller arm 107. The edge region of roller mechanism support bracket 100 disposed between roller arm stops 102 and 103 forms a detent cam 104.

In operation, the embodiment of the anti-slide-out device of this invention shown in FIGS. 6*a*–6*e* acts in a manner analogous to that of the embodiment of FIGS. 5*a*–5*e* as described hereinabove, except that it has been modified to preclude ladder 10 from being set up at an angle shallower than the desired inclination angle θ, even under action of a live load W as indicated by arrow 111, as shown in FIGS. 6*a* and 6*b*. The transition from the embodiment of FIG. 5 to that of FIG. 6 is accomplished by removing the cam hump of detent cam 104 closest to ladder 10, repositioning roller arm stop 103 closest to ladder 10, and repositioning spring support pin 108 so as to no longer be disposed along the longitudinal axis of roller arm 107. As shown in FIGS. 6*c* and 6*d*, when ladder 10 is positioned with the desired set-up angle θ, there is no slide-out of the ladder under either the unloaded condition of FIG. 6*c* or the loaded condition with sag due to the load of 6*d*. As in the case of the embodiment shown in FIGS. 5*a*–5*e*, after using the ladder, the user can restore roller 11 to its neutral position by hand by moving roller arm 107 to the position shown in FIG. 6*e*.

Figure 7:
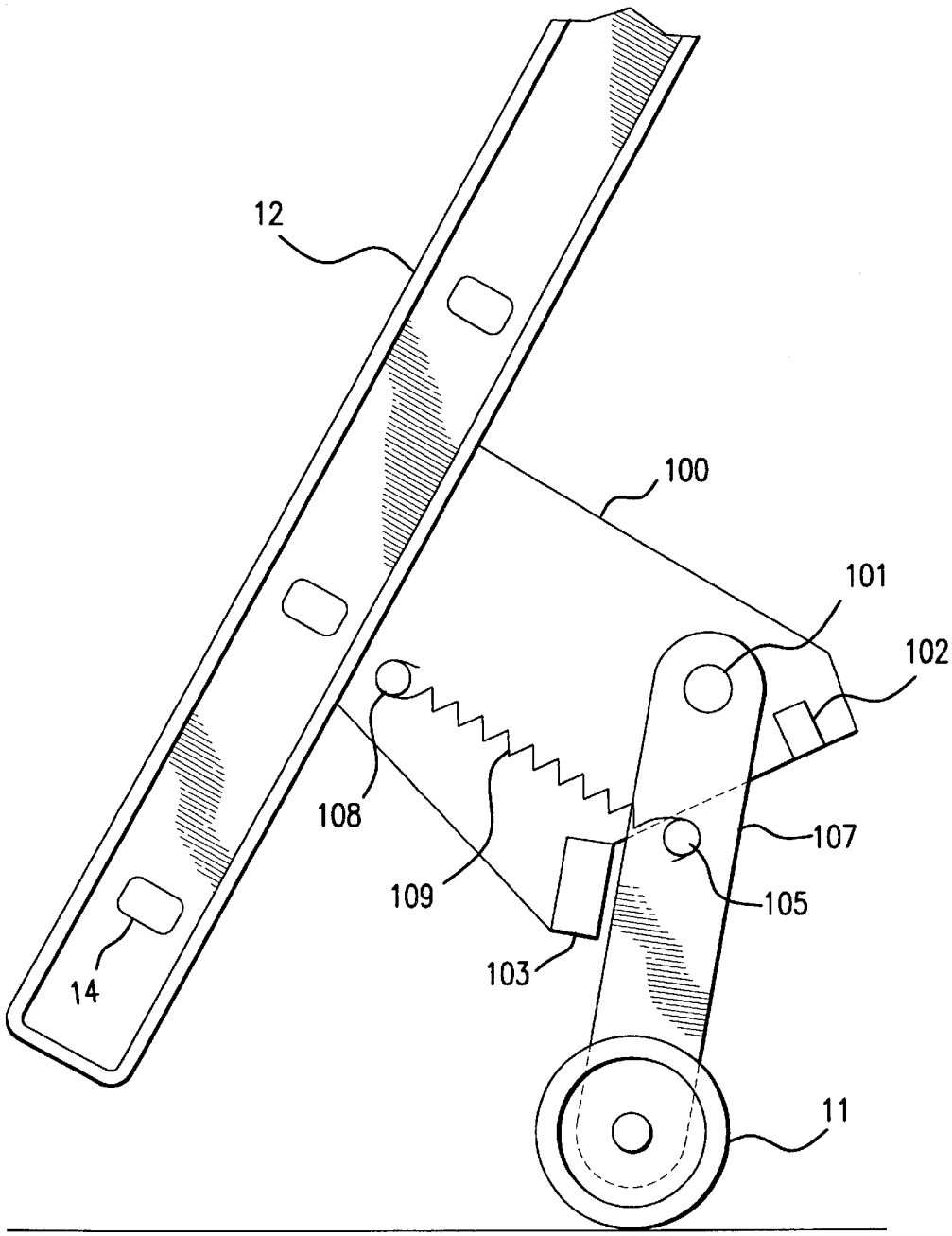
FIG. 7 is a side view of an anti-slide-out device for a straight or extension ladder in accordance with yet another embodiment of this invention.

FIG. 7 shows yet another embodiment of the anti-slide-out device of this invention utilizing the roller support device substantially as shown in FIG. 6*e*. The device and its mechanism, when utilized on a ladder, cause the ladder to act in a manner analogous to the ladder of FIGS. 6*a*–6*e* except that it has been modified in a manner which eliminates the snap-out retraction of roller 11 and roller arm 107 to an out-of-the-way position. This is achieved by removing the cam hump of the embodiment shown in FIG. 6*e* and eliminating detent slot 106, which is no longer necessary. This modification enables roller 11 and roller arm 107 to give under sag due to the presence of a live load at the set-up angle θ, but does not retract them to an out-of-the-way position as shown in FIG. 6*d*. In this case, when the live load is removed from the ladder, or if the ladder is lifted up, roller arm 107 and roller 11 automatically return to their neutral position with respect to roller mechanism support bracket 100 as shown in FIG. 7.

Figure 8:
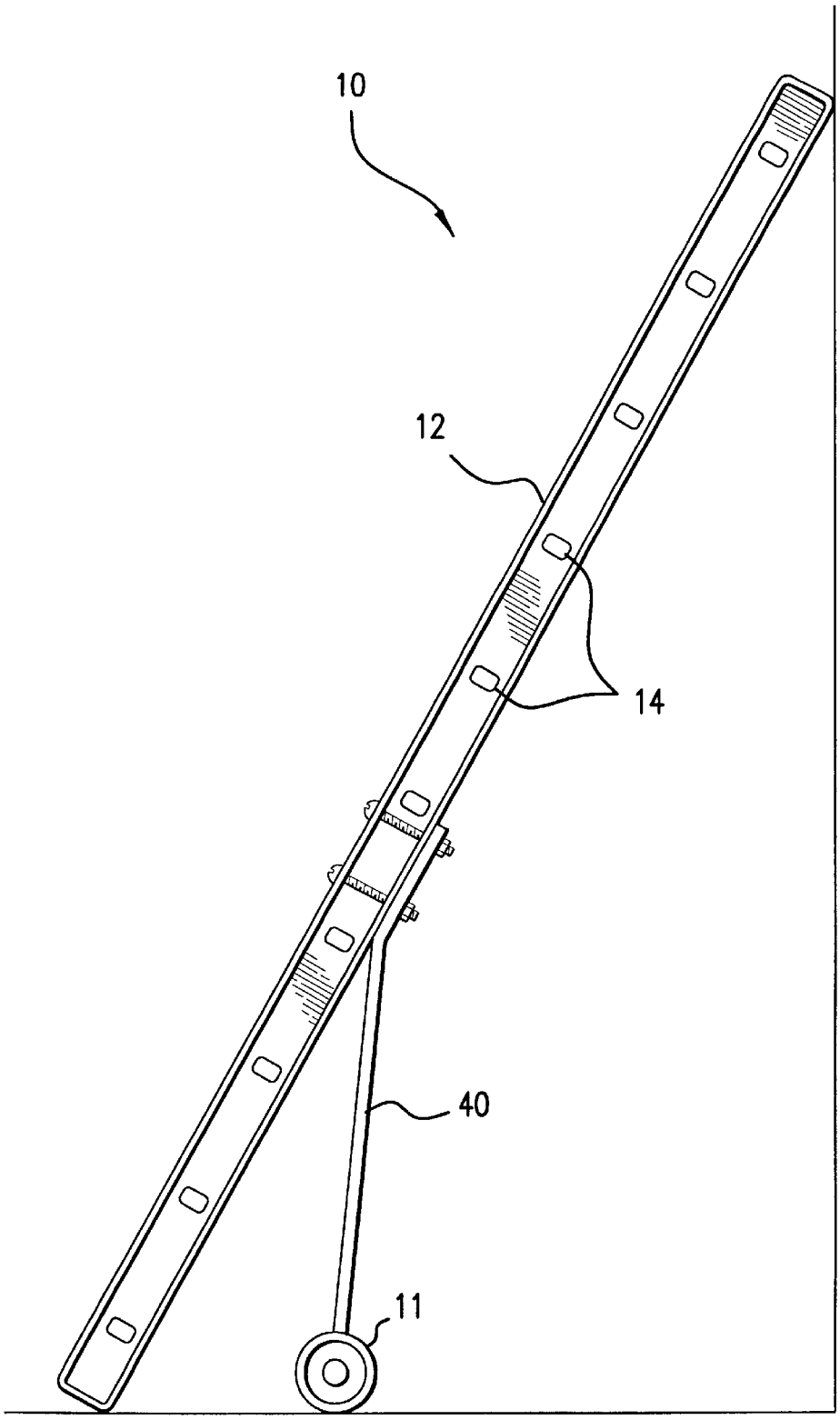
FIG. 8 is a side view of a ladder comprising an anti-slide-out device in accordance with one embodiment of this invention.

In accordance with one embodiment of the anti-slide-out device of this invention, rollers 11 are elastically mounted without preloading as shown in FIG. 8. Roller 11 is connected to one end of flat spring 40, the opposite end of which is connected to side rails 12 of ladder 10. Due to the extreme simplicity of this embodiment, the device has high reliability, high robustness and the potential for minimum cost. In addition, to satisfy horizontal storage requirements, the device can be deflected flat against side rails 12 when not in use.

Figure 9:
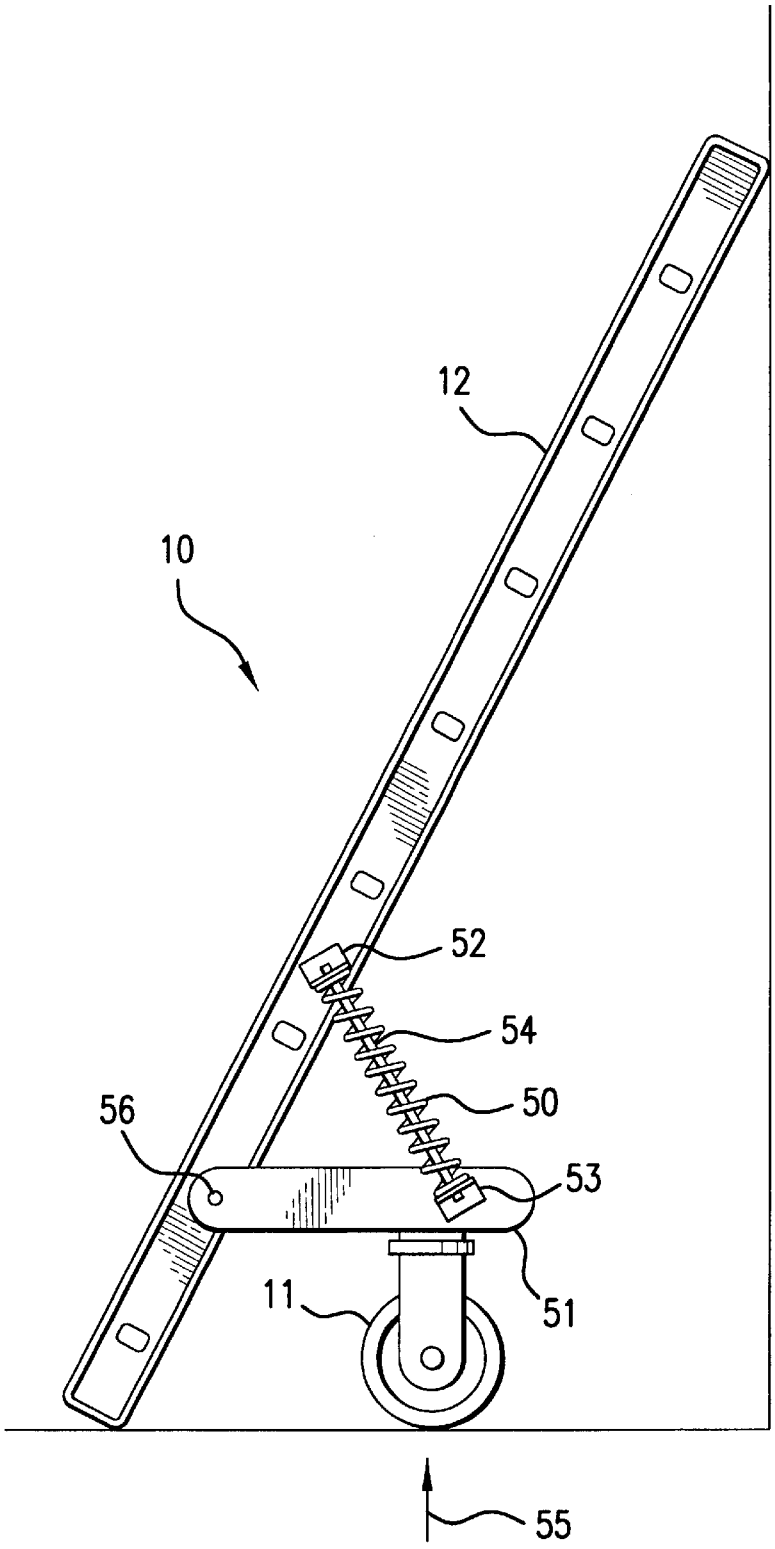
FIG. 9 is a side view of a ladder comprising an anti-slide-out device comprising a preloaded spring suspension in accordance with one embodiment of this invention.

FIG. 9 is a side view of an anti-slide-out device similar to the device shown in FIG. 2 utilizing a preloaded spring system. The device comprises roller 11 connected to an underside of an elongated pivotal bracket 51 having one end pivotally connected to side rails 12 by means of hinge pin 56. A first angle bracket 52 is connected to side rail 12 at a position above hinge pin 56 and a second angle bracket 53 is attached to the end of elongated pivotal bracket 51 opposite to the end connected to side rail 12. A rod 54 is slidably connected to first angle bracket 52 and second angle bracket 53. Preloaded spring 50 surrounds rod 54 between first angle bracket 52 and second angle bracket 53. Preloaded compression spring 50 pretensions rod 54, as a result of which the suspension will act rigidly until sufficient roller reaction force, indicated by arrow 55, overcomes the preload whereupon preloaded compression spring 50 will exhibit elastic behavior.

Figure 10:
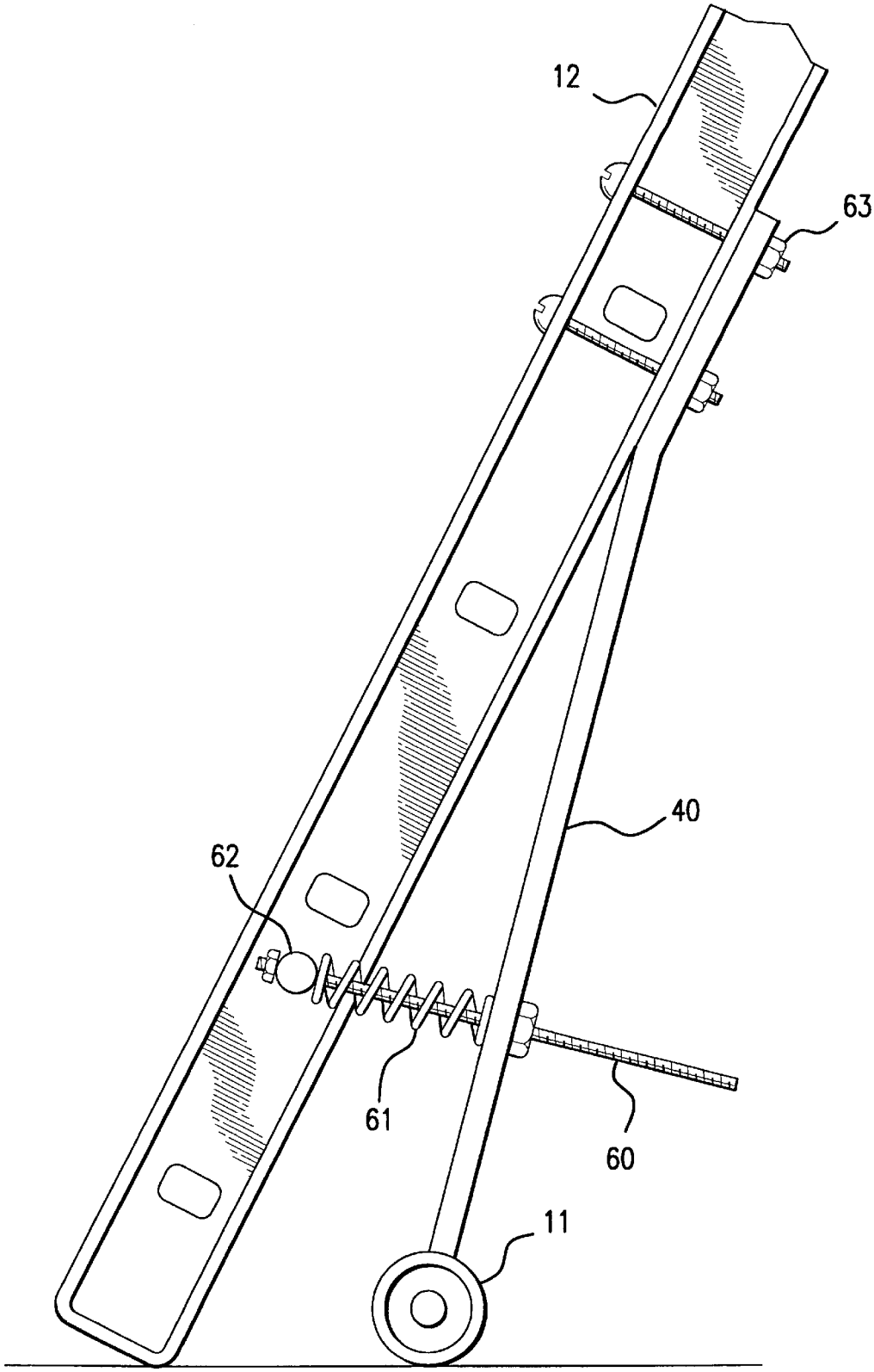
FIG. 10 is a side view of an anti-slide-out device comprising a preloaded flat spring suspension in accordance with one embodiment of this invention.

In accordance with one embodiment of this invention shown in FIG. 10, the elastically mounted roller system of FIG. 8 is preloaded. The device comprises flat spring 40 connected at one end by attachment means 63 to side rail 12 and having roller 11 connected at an opposite end thereof. Threaded rod 60 has one end extending through flat spring 40 and an opposite end connected by pin 62 to side rail 12. Surrounding threaded rod 60 in the area between flat spring 40 and pin 62 is preloaded spring 61.

Figure 11:
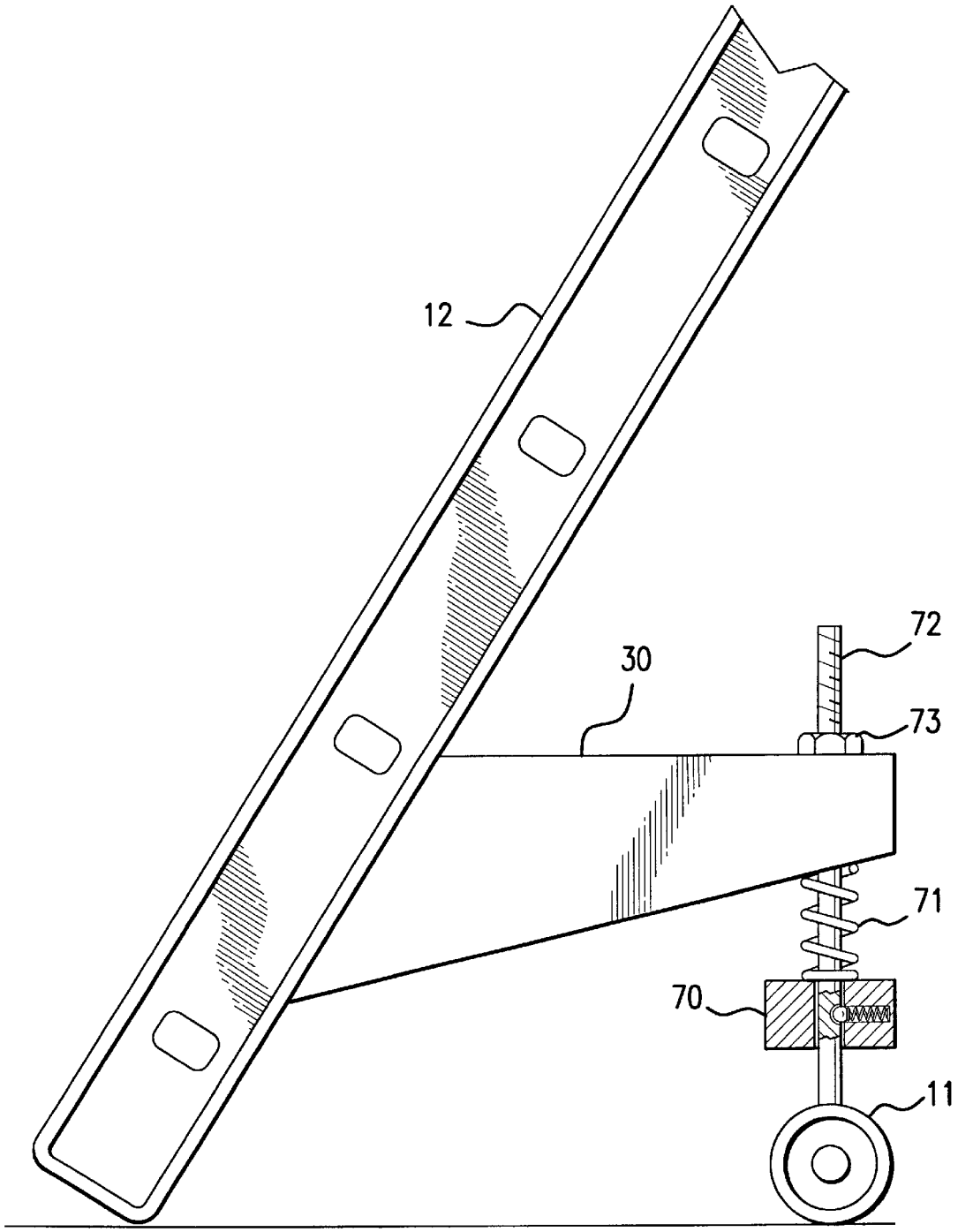
FIG. 11 is a side view of an anti-slide-out device comprising a detented slider in accordance with one embodiment of this invention.

In accordance with one embodiment of this invention as shown in FIG. 11, the anti-slide-out device incorporates a mechanism that acts as a mechanical fuse to unload the springs when their compression force reaches a preset limit. The device comprises fixed bracket 30 connected to side rails 12. Roller 11 is connected to one end of vertically oriented threaded rods 72, the other end of which extends through fixed bracket 30 and is held inplace by nut 73. Connected to threaded rod 72 proximate to roller 11 is detented force limiter 70. Disposed between detented force limiter 70 and fixed bracket 30, and surrounding threaded rod 72 is preloaded spring 71. As shown in FIG. 11, detented force limiter 70 is merely a detented slider. It should be noted that the detented slider must be manually reset or repositioned after it has acted to unload the spring by sliding downward.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A device for use with anon-self-supporting ladder having two substantially parallel, elongated, spaced apart side rails having an upper end and a lower end and a plurality of substantially parallel, spaced apart rung elements joining said spaced apart side rails, the device comprising, an inboard roller assembly adapted to be positioned at a base of said ladder and comprising a pair of brackets adapted to be connected to a respective one of said spaced apart: side rails, each bracket having a pair of roller arm stops, an elongated roller arm pivotally connected to each bracket and pivotable between and selectively contacting the pair of roller aim stops and a roller rotatable over its central axis attached to each of said elongated roller arms, said inboard roller assembly adapted to impose a specified ladder inclination angle (θ) between said spaced apart side rails and a substantially flat horizontal surface when said lower end of said spaced apart side rails, and said rollers rest on the substantially flat horizontal surface.

2. A device in accordance with claim 1, wherein said specified ladder inclination angle is at least about 75 degrees.

3. A device in accordance with claim 1, wherein said rollers are wheels.

4. A device in accordance with claim 1, wherein said rollers are pneumatic tire wheels.

5. A device in accordance whit claim 1, wherein said rollers are moveably, attached to said brackets.

6. A device in accordance with claim 1, wherein said rollers are elastically attached to said brackets in a manner utilizing preloading.

7. A device in accordance with claim 1, wherein said inboard roller assembly is detachable from said side rail.

8. A device in accordance with claim 1, wherein said roller arms are movable into a storage position.

9. A device in combination with a ladder for preventing slide-out comprising;

anti-slide-out means attached to a base of said ladder and in operative association with a support surface for effecting a minimum ladder set-up angle between said support surface and said ladder, said anti-slide-out means having a pair of brackets adapted to be attached to said base, each bracket with a pair of roller arm stops and an elongated roller arm pivotable between and selectively contacting the pair of roller arm stops precluding said base of said ladder from sliding away from a structure against which said ladder is leaning upon application of a weight on said ladder.

10. A device in accordance with claim 9, wherein each said roller arm includes a roller, the central axis of said roller oriented so as to be substantially parallel to rungs of said ladder and disposed so as to impose said minimum set-up angle when a base of said ladder and said inboard rollers rest on a substantially flat, horizontal support surface.

11. A device in accordance with claim 10, wherein said anti-slide-out means further comprises retraction means for retracting said roller arm from a ladder set-up position to a retraction position whereby only the base of said ladder contacts s;aid substantially flat horizontal support surface.

12. A device in accordance with claim 11, wherein said anti-slide-out means further comprises means for returning said roller arm from said retraction position to said ladder set-up position.

13. A non-self-supporting ladder comprising:

two substantially parallel, elongated, spaced apart side rails having an upper end and a lower end;

a plurality of substantially parallel, spaced apart rung elements joining said spaced apart side rails; and an inboard roller assembly comprising a pair of brackets connected to a respective one of said spaced apart side rails and a roller rotatable over its central axis attached to each of said brackets, said inboard roller assembly disposed so as to impose a specified ladder inclination angle ($\theta$) when said lower end of said spaced apart side rails and said rollers rest on a substantially flat horizontal surface, wherein said inboard roller assembly further comprises an elongated roller arm pivotally connected to each bracket, said roller arm forming a longitudinally oriented detent slot and comprising a detent pin disposed within said detent slot, each bracket is fixedly connected to a respective one of said side rails and forming a detent cam suitable for receiving said detent pin along a bracket edge, said bracket further comprises a roller arm stop on each side of said detent cam and a spring support pin disposed at a distance from said detent cam, and a pretensioned spring connected at one end to a cam pin and at an opposite end to said spring support pin.

* * * * *